United States Patent [19]

Calderone

[11] 4,064,573

[45] Dec. 27, 1977

[54] CLEANSER-SANITIZER AND TIMED CYCLE DEODORIZING SPRAY ATTACHMENT FOR TOILETS

[75] Inventor: Joseph F. Calderone, Scottsdale, Ariz.

[73] Assignee: Cahill, Sutton & Thomas, Phoenix, Ariz.

[21] Appl. No.: 739,549

[22] Filed: Nov. 8, 1976

Related U.S. Application Data

[63] Continuation-in-part of Ser. No. 582,739, July 2, 1975, abandoned.

[51] Int. Cl.[2] ..... E03D 9/02

[52] U.S. Cl. ..... 4/227; 4/228; 222/57; 222/402.2

[58] Field of Search ..... 4/222–224, 4/227, 228; 222/57, 402.2, 380, 402.21, 402.22, 402.23

[56] References Cited

U.S. PATENT DOCUMENTS

| | | | |
|---|---|---|---|
| 2,734,667 | 2/1956 | Conklin | 222/380 X |
| 3,023,427 | 3/1962 | Behringer | 4/228 |
| 3,169,677 | 2/1965 | Focht | 222/402.2 |
| 3,254,797 | 6/1966 | Porter | 4/228 X |
| 3,521,306 | 7/1970 | Jacobs | 4/228 |

*Primary Examiner*—Richard E. Aegerter
*Assistant Examiner*—Stuart S. Levy
*Attorney, Agent, or Firm*—Cahill, Sutton & Thomas

[57] ABSTRACT

An attachment for a toilet is disclosed which produces a cleanser-sanitizer solution with the water stored in the flush tank and which produces an aerosol spray of deodorizer for a fixed duration midway through each flushing cycle. The attachment is substantially contained within the flush tank of the toilet and is actuated in response to the level of the water in the tank.

8 Claims, 4 Drawing Figures

CLEANSER-SANITIZER AND TIMED CYCLE DEODORIZING SPRAY ATTACHMENT FOR TOILETS

The present application is a continuation-in-part application of a pending patent application entitled "CLEANSER-SANITIZER AND TIMED CYCLE DEODORIZING SPRAY ATTACHMENT FOR TOILETS," filed on July 2, 1975, and assigned Ser. No. 582,739, now abandoned.

FIELD OF THE INVENTION

This invention relates generally to dispensing devices, and more particularly, to such devices for producing a cleansing-sanitizing solution in the water of a toilet flush tank and for producing an aerosol spray of fixed duration to deodorize the air in the vicinity of the toilet.

BACKGROUD OF THE INVENTION

The soil and ordor associated with a conventional toilet is a source of considerable concern to many people. One need merely consider the quantity of advertising directed to products for cleaning toilets and for freshening the air to gain some insight into the concern directed towards this problem. With the possible exception of food preparation areas in the kitchen, the typical housewife probably cleans the bathroom toilet significantly more often than other areas in the home. As substantial a problem as this may be in the household, it is even more pressing a problem in public restrooms. Not only are public restrooms used significantly more often than the bathroom in a residence, it is used by transients who have little pride or concern in the appearance or condition of the toilet facility they leave behind. Because of the lack of sanitation associated with them, significant portions of our population are reluctant to use public toilet facilities.

Numerous efforts have been directed towards solving the problem of sanitation and odor in bathrooms in general, and in particular, those toilet facilities associated with public places. An enthusiastic housewife may clean the toilets of a private residence daily. Many public toilet facilities have full time attendants to maintain cleanliness in the facility. Any number of devices have been tried to produce sanitary, odor free surroundings in such public accommodations. These devices have run the gamut from liquid dispensers to electronic odor neutralizers, to aerosol spray devices that operate on timed cycles to apparatus connected to each toilet within a facility.

In his 1957 U.S. Pat. No. 2,795,799, J. Dickerman disclosed an aerosol deodorant can that was actuated by a downward pressure on the seat of a conventional toilet. In 1962, N. W. Price disclosed, in U.S. Pat. No. 3,068,492, apparatus for attaching an atomizer deodorant can to the outside of a toilet flush tank to be actuated whenever the flush handle was depressed. D. T. Behringer, in U.S. Pat. No. 3,023,427, issued in 1962, disclosed a device which could be located within the flush tank of a conventional toilet and was effective for sterilizing and deodorizing the bowl of the toilet. Apparatus was disclosed in 1963 by M. Kaplan in U.S. Pat. No. 3,093,835, for locating a spray deodorizer within the flush tank of a conventional toilet and discharging a deodorant spray outside the flush tank into the air of the room surrounding the toilet.

The devices of the prior art have not been totally satisfactory in resolving the problems discussed. None of these devices is effective both within the toilet and in the air of the surrounding as well. The devices disclosed by Dickerman, Price and Kaplan are effective only to discharge a deodorant spray into the air. Such devices are completely ineffective for cleansing the toilet bowl of fecal residue and insuring that the bowl is in a sanitized condition at the completion of the flush cycle. Conversely, Behringer's device is associated only with flush water discharged into the toilet bowl. It is completely ineffective for overcoming flatulence or fetor from the bowl effluvium which may have escaped from the bowl area to foul the air surrounding the oilet.

It is therefore an object of my invention to provide apparatus for both cleansing and sanitizing the bowl of a toilet and for deodorizing the air surrounding the toilet.

The Price and Dickerman devices present an unsightly appearance because of their location outside the enclosure of the toilet.

Therefore, it is also an object of my invention to provide cleansing-sanitizing and deodorizing apparatus which is located substantially within the flush tank of a toilet.

The device disclosed by Behringer is operated by a lever separate from that required to flush the toilet. Since public toilet users frequently do not even flush the toilet when leaving, it could be reasonably expected that the second lever would be operated even less frequently.

It is a further object of my invention to provide cleansing-sanitizing and deodorizing apparatus that operates automatically in response to the toilet flush cycle.

The Kaplan and Price devices are actuated by the flush mechanism and resultingly produce a deodorant spray coincident with the initiation of the flush cycle. Since the suction effect of water leaving the toilet bowl will tend to entrap odoriferous vapors, not only will disagreeable odors be so entrapped, but also any deodorant vapor may also be entrapped.

It is yet another object of my invention to provide a deodorizing spray that is automatically actuated during the mid-portion of the flush cycle when the water level of the toilet bowl ebbs and the bowl begins to refill.

It is still another object of my invention to provide a deodorizing apparatus which contains a timing means for preventing the release of deodorant spray from the apparatus for a predetermined time after each flushing operation.

SUMMARY OF THE INVENTION

In accordance with the present invention, apparatus is disclosed for both producing a cleanser-sanitizer solution in the water in the flush tank of a toilet and for producing a fixed duration spray from an aerosol deodorant container during the middle of each flush cycle.

OPERATION OF AN ILLUSTRATIVE EMBODIMENT

As the water level rises in a toilet flush tank containing apparatus embodying my invention, the rising water comes into contact with a solid block of cleanser-sanitizer contained within the apparatus. Since the block is water soluble, a portion of the block dissolves, producing a cleanser-sanitizer solution in the water within the filled flush tank. When the flush cycle of the toilet is initiated, the cleanser-sanitizer solution will discharge from the flush tank into the toilet bowl. Approximately when the toilet flush tank water level has been drained to the one-half full level, a spray of aerosol deodorant is discharged into the air surrounding the toilet. The duration of the spray is predetermined to discharge a desired quantity of deodorant. The refilling of the flush tank again produces the cleanser-sanitizer solution in the flush tank and the apparatus embodying my invention is ready for the next toilet flush cycle.

DETAILED DESCRIPTION OF AN ILLUSTRATIVE EMBODIMENT

Figure 1:
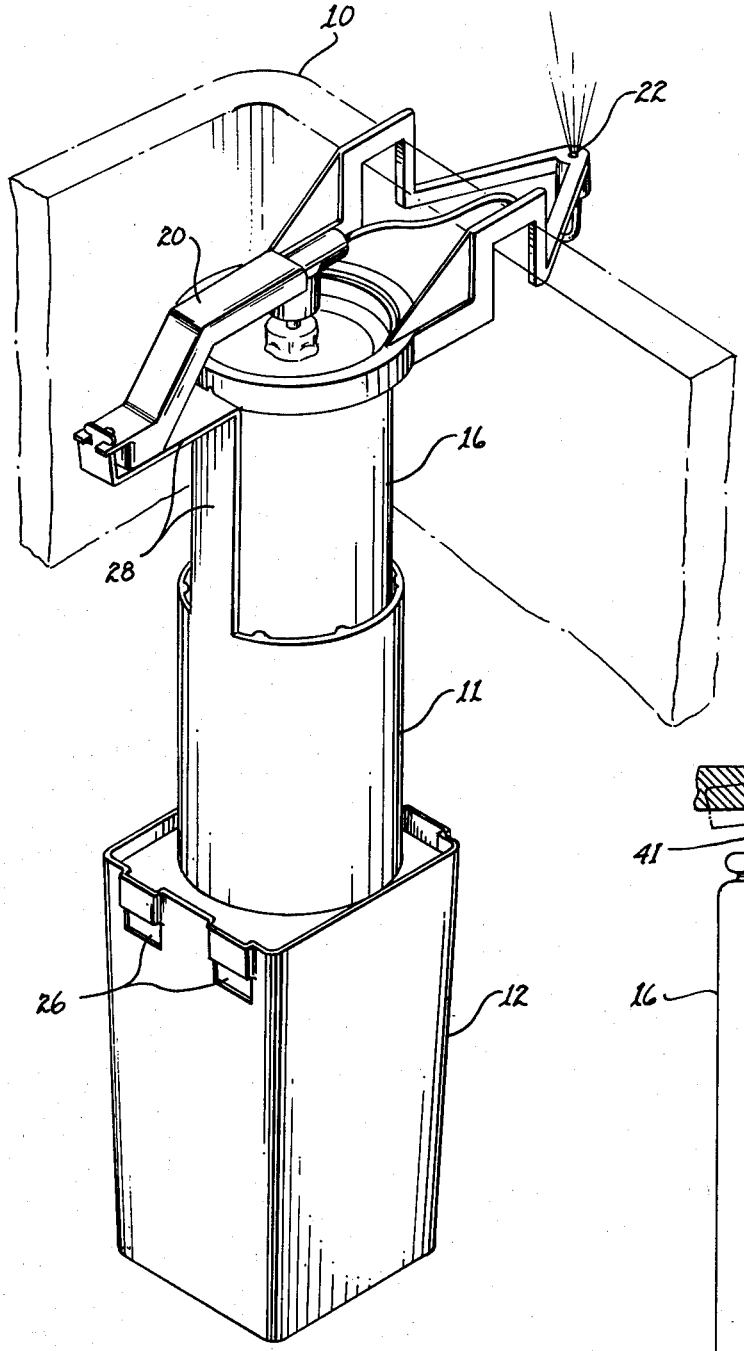
FIG. 1 is a perspective view of the apparatus in accordance with my invention.

A unit embodying my invention is shown in perspective in FIG. 1. The unit is adapted for submersion in the water contained within the flush tank 10 of a conventional toilet. The unit includes a skirt 11 for surrounding an aerosol spray can 16 containing deodorant spray. Contiguous to skirt 11 is a cleanser-sanitizer tank 12. The actuation of the unit is controlled by the water level in flush tank 10 which operates a spray lever 20 as will be explained later in detail.

Figure 2:
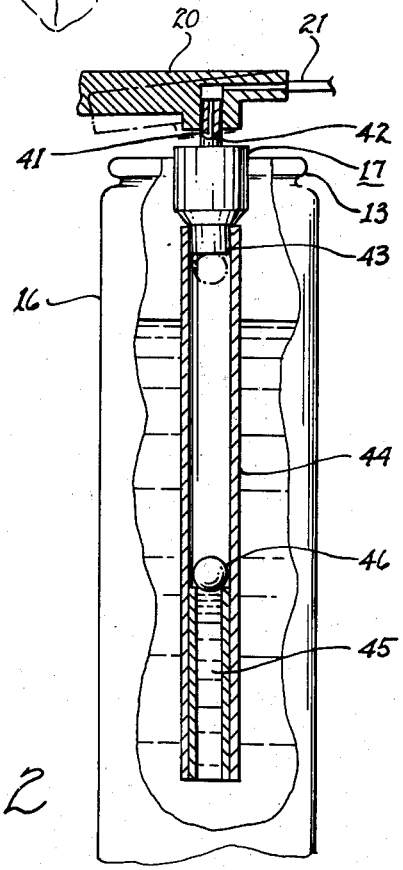
Fig. 2 is a partial elevation view of the apparatus of FIG. 1 shown partially in cross-section.

The actuation of spray can 16 can be readily understood from FIG. 2. Spray lever 20 is inserted over top of spray valve assembly 17 of the aerosol spray can 16. When spray lever 20 moves to the dotted position, in response to the low water level in the flush tank, as will be explained later in detail, a quantity of aerosol deodorant spray is discharged from a standpipe 44 through valve assembly 17 and into delivery tube 21. The deodorant spray is then discharged into the atmosphere of the area surrounding the toilet through a nozzle 22 shown in FIG. 1.

Figure 3:
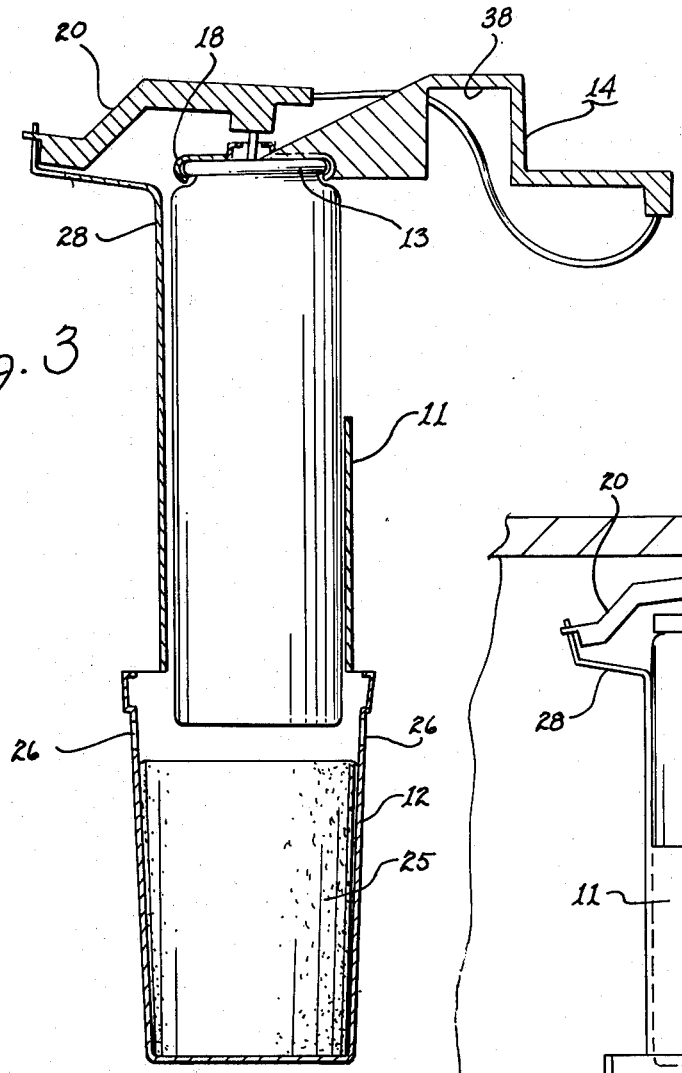
FIG. 3 is an elevation view of the apparatus of FIG. 1 shown in cross-section.
Figure 4:
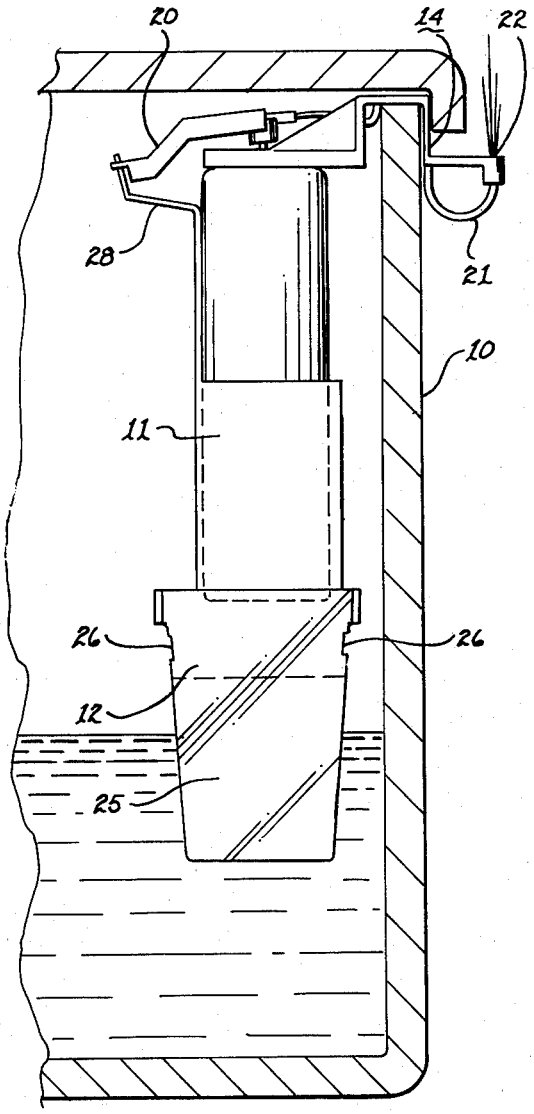
FIG. 4 is an elevation view of the apparatus of FIG. 1 shown in position in a toilet flush tank.

FIG. 3 shows a cross-sectional view taken through the unit embodying my invention, shown in the position coinciding with a filled flush tank, or an unoperated condition. In FIG. 4, the unit is shown actuated in response to the low water level of the flush tank. The unit embodying my invention may be suspended in the water of flush tank 10 by hooking a hanger 38 of a hanger assembly 14 over the top edge of tank 10. Hanger 38 connects to a top 18 which in turn engages the top rim 13 of spray can 16. Spray can 16 contains an aerosol room deodorant which is discharged in response to a low water level in flush tank 10, as will be explained later in detail. Suspended below skirt 11, which surrounds spray can 16, is a solution tank 12 containing a block 25 of cleanser-sanitizer including a surface active agent. Tank 12 includes several slots 26 at its upper periphery to permit water from flush tank 10 to mix with block 25. Water entering slots 26 will dissolve a portion of block 25 and produce a solution of surface active cleanser-sanitizer in conjunction with the water in flush tank 10.

When the flush cycle is initiated, the surface active cleanser-sanitizer solution contained in flush tank 10 is delivered to the toilet bowl (not shown), the surface active agent acts, in conjunction with the swirling action of the flush water, to prevent any residue from adhering to the toilet bowl. The cleanser-sanitizer solution is thereby effective to leave the toilet bowl in a clean and sanitary condition.

As the water in flush tank 10 is delivered to the toilet bowl, the water level in the flush tank will go down. Since the combination of skirt 11, tank 12 and block 25 are made to float in the water of flush tank 10, as the water level in the flush tank goes down the floating portion of the apparatus will move down with the water to the position shown in FIG. 4. Skirt 11 connects to a connecting tab 28 which attaches to the end of spray lever 20. As skirt 11 moves down with the flush tank water level, tab 28 pulls down on the end of spray lever 20 which initiates a one second discharge from spray can 16.

A one second aerosol spray is sufficient to deodorize the toilet area. Since spray lever 20 will be downward a substantially longer period, a means for terminating the aerosol spray, other than the return of lever 20 to its upward position, must be provided. Spray valve assembly 17, shown in FIG. 2, operates in a conventional manner, however, standpipe 44 has been modified by the insertion of a timing tube 45 and a check ball 46. Referring now to FIGS. 2 and 4, spray valve assembly 17 is actuated by the downward motion of solution tank 12 during the flushing operation of the toilet. Spray lever 20 is coupled to the upper end of valve outlet tube 42. Skirt 11 and connecting tab 28 transmit the downward motion of solution tank 12 to the outer end of spray lever 20. The downward displacement on the outer end of spray lever 20 causes rotation of tilting of the upper end of valve outlet tube 42. Spray valve assembly 17 is one of a variety of different types of tilt-actuated valves which are commercially available. The tilting action imparted to the upper part of spray valve assembly 17 by spray lever 20 actuates the valve assembly and allows the pressurized liquid within can 16 to be discharged through central passageway 41 into delivery tube 21. The pressurized spray flows through delivery tube 21 around hanger assembly 14 and is then discharged through nozzel 22 into the interior of the bathroom where the toilet assembly is installed. Check ball 46 was initially supported by the upper end of a timing tube 45 inserted into the lower end of standpipe 44. Check ball 46 is sufficiently smaller than standpipe 44 to permit the passage of liquid. As the passage of liquid continues upward through standpipe 44, check ball 46 is carried upward with the moving liquid.

When check ball 46 reaches the top of standpipe 44, it will close off a valve inlet aperture 43 into valve assembly 17. This terminates the flow of liquid into delivery tube 21 regardless of the position of spray lever 20. The length of spray is related to the distance between the top of timing tube 45 and the top of standpipe 44. The length of spray can be increased or decreased bu decreasing or increasing, respectively, the length of timing tube 45. When spray lever 20 returns to the upright position, the equalization of pressure at the top and bottom of check ball 46 will cause the ball to fall until it comes to rest at the top of timing tube 45 to await the next spray cycle. Not only does the timing cycle of spray valve assembly 17 limit the deodorant spray to an effective length, but also prevents multiple sprays from occurring as a result of handling or tampering. Since a recovery period is required before the spray mechanism will be operable, children cannot readily discharge the contents of spray can 16 by playing with the apparatus.

While check ball 46 has typically been constructed of steel, it has been found that superior results can be achieved if check ball 46 is fabricated from specially selected rubber. The rubber version of check ball 46 can be fabricated from rubber such as Buna N or Vitton. It has also been found that the rubber check ball embodiment should be fabricated so that it has a hardness of approximately seventy durometer. Rubber check ball 46 must be specially fabricated and milled so that it is as nearly spherical as possible. With a rubber check ball, timing tube 45 can be of such a length so that the uppermost portion thereof lies approximately one-half inch below valve inlet aperture 43. This will permit quarter second discharges of deodorant.

Fabrication of check ball 46 from rubber instead of steel provides a number of advantages. When the top of timing tube 45 is placed one-sixteenth inch below valve inlet aperture 43, a minimum discharge time of one second is possible with a steel check ball. With a rubber check ball a one-fourth second burst of deodorant can be obtained when top of timing tube 45 is one half inch below valve inlet aperture 43. With a rubber check ball, even shorter discharge times are possible. It is impractical to obtain a shorter burst duration with a steel check ball 46 since the upper end of timing tube 45 would have to have been too close valve inlet aperture 43. Because of the shorter burst duration available with a rubber check ball, the concentration of the liquid deodorant within the pressurized spray can 16 could be substantially increased. Thus it was possible to obtain a greater number of shorter duration sprays prior to exhausting the liquid deodorant within container 16. It was also found that the rubber check ball embodiment operated more reliably and sealed more completely after each actuation, again having the effect of increasing the number of potential activations prior to exhaustion of the liquid deodorant.

An additional advantage of using a rubber check ball is that approximately twenty minutes is required before the rubber check ball descends from valve inlet aperture 43 to the upper end of timing tube 45. If the flush tank of the toilet is drained ten minutes after previous actuation virtually no aerosol deodorant will be dispensed since the rubber check ball will still be in contact with the valve inlet aperture 43. After between ten and twenty minutes of the draining of the toilet tank, an additional draining will effect only a minimal discharge of aerosol deodorant. The light weight or low density of the rubber check ball 46 provides this timing means effect which is far superior to that obtainable with a steel check ball.

Because of the special hardness characteristics of rubber check ball 46, the seal between the check ball and valve inlet aperture 43 is virtually perfect. Thus if the toilet drain valve in the toilet tank sticks upen and the tank continuously drains, the deodorant dispensing apparatus will be totally sealed and will not leak liquid deodorant past valve inlet aperture 43 during the lengthly time when the deodorant dispenser is actuated by the low water level.

Because block 25 has a density approaching that of water, the buoyancy of the floating portion of the apparatus will not change as the block is dissolved in use. The portion of tank 12 below slots 26 will fill with water so that the weight of the combination of block 25, tank 12 and any contained water will not vary significantly. As the water level in flush tank 10 rises following delivery of the cleanser-sanitizer solution to the toilet bowl, the floating portion of the apparatus will return to the position shown in FIG. 3. Once again, water from flush tank 10 will enter slots 26 and mix with the ingredients of block 25 to produce a cleanser-sanitizer solution in the flush tank and ready the apparatus for the next flush cycle.

The one second aerosol burst from nozzle 22 will propel approximately 120 million small particles of deodorant liquid from can 16 into the surrounding air. Under average conditions, a substantial portion of those particles will remain airborne for fifty to sixty minutes. The disclosed apparatus would be suitable for 225–250 flush cycles before can 16 and block 25 would be replaced. It should be emphasized that the embodiment described and the values recited are for illustrative purposes only. Numerous other configurations and modifications could be made by those skilled in the art without departing from the spirit and scope of the invention which I claim.

I claim:

1. In an apparatus located within the flush tank of a toilet for dispensing a measured amount of aerosol deodorant spray into the atmosphere surrounding the toilet and including: a pressurized spray can containing liquid deodorant and having a normally closed, tilt-actuated atomizing valve, a tube disposed within the can for delivering liquid deodorant to the valve, a sphere disposed within the tube and translatable thereinalong for a limited distance from a retainer through the tube to the valve; the improvement comprising in combination:

a. valve actuating means for exerting a tilting force on the valve sufficient to actuate the valve, said valve actuating means comprising
   i. a receptacle displaceable upwardly and downwardly in response to changes in the water level in the flush tank;
   ii. lever means coupled to said receptacle and to said valve for actuating said valve when said receptacle moves downwardly and for converting the force derived from the downward movement of said receptacle to a tilting force for actuating the valve, said lever means including guide means in contact with the outer surface of the can for vertically aligning said receptacle with the outer surface of said can during the upward and downward displacement of said receptacle;

b. a seat disposed at the lower portion of the valve for seating the sphere and, upon upward flow of deodorant through the tube causing corresponding movement of the sphere from the retainer to said seat, terminating the flow of the liquid deodorant into the valve;

c. conduit means for transporting the aerosol deodorant spray from the valve into the atmosphere surrounding the toilet; whereby, the act of flushing the toilet causes the receptacle to be displaced downwardly to operate said valve actuating means and to dispense a measured amount of deodorant spray into the atmosphere surrounding the toilet.

2. The apparatus of claim 1 wherein said lever means includes first and second pivotally connected lever arms, said first lever arm attached to said valve and said second lever arm attached to said guide means.

3. The apparatus of claim 2 wherein said receptacle includes a water soluble block of chemical cleanser sanitizer and wherein said receptacle has at least one hole for permitting water to enter said receptacle and mix with said block and for permitting the resulting solution to leave said receptacle; whereby a chemical cleanser-sanitizer solution is produced with the water in the flush tank and discharged into the toilet bowl during the flushing cycle.

4. In an apparatus located within the flush tank of a toilet for dispensing a measured amount of aerosol deodorant spray into the atmosphere surrounding the toilet and including: a pressurized spray can containing liquid deodorant and having a normally closed, tilt-actuated atomizing valve, a tube disposed within the can for delivering liquid deodorant to the valve, a sphere disposed within the tube and translatable thereinalong for a limited distance from a retainer through the tube to the valve; the improvement comprising in combination:

a. valve actuating means for exerting a tilting force on the valve sufficient to actuate the valve, said valve actuating means comprising
   i. a receptacle displaceable upwardly and downwardly in response to changes in the water level in the flush tank;
   ii. lever means coupled to said receptacle and to said valve for actuating said valve when said receptacle moves downwardly and for converting the force derived from the downward movement of said receptacle to a tilting force for actuating the valve, said lever means including guide means in contact with the outer surface of the can for vertically aligning said receptacle with the outer surface of said can during the upward and downward displacement of said receptacle;

b. a seat disposed at the lower portion of the valve for seating the sphere and, upon upward flow of deodorant through the tube causing corresponding movement of the sphere from the retainer to said seat, terminating the flow of the liquid deodorant into the valve;

c. conduit means for transporting the aerosol deodorant spray from the valve into the atmosphere surrounding the toilet;

d. timing means for controlling the rate of return of the sphere from said seat to the retainer and for preventing the release of deodorant spray from said valve for a predetermined time after the termination of each actuation of said valve;

whereby, the act of flushing the toilet causes the receptacle to be displaced downwardly to operate said valve actuating means and to dispense a measured amount of deodorant spray into the atmosphere surrounding the toilet.

5. The apparatus of claim 4 wherein said lever means includes first and second pivotally connected lever arms, said first lever arm connected to said valve and said second lever arm connected to said guide means.

6. The apparatus of claim 5 wherein said receptacle includes a water soluble block of chemical cleanser-sanitizer and wherein said receptacle has at least one hole for permitting water to enter said receptacle and mix with said block and for permitting the resulting solution to leave said receptacle; whereby a chemical cleanser-sanitizer solution is produced with the water in the flush tank and discharged into the toilet bowl during the flushing cycle.

7. The apparatus of claim 6 wherein said timing means includes said sphere fabricated from rubber having a durometer rating between 50 to 95.

8. The apparatus of claim 7 wherein said timing means includes said sphere fabricated from rubber having a durometer rating between 60 to 80.

* * * * *